United States Patent [19]

Bingham et al.

[11] 3,943,807

[45] Mar. 16, 1976

[54] AUTOMATED ENVELOPE OPENER

[75] Inventors: George H. Bingham, Los Altos; Edward A. Krupotich, Palo Alto, both of Calif.

[73] Assignee: Omation Corporation, Palo Alto, Calif.

[22] Filed: Jan. 14, 1975

[21] Appl. No.: 541,007

[52] U.S. Cl. ..... 83/79; 53/381 R; 83/88; 83/100; 83/355; 83/417; 83/418; 83/422; 83/425; 83/912

[51] Int. Cl.[2] ..... B26D 1/20

[58] Field of Search ..... 83/79, 88, 100, 417, 418, 83/422, 425, 912, 355; 53/381 R

[56] References Cited

UNITED STATES PATENTS

| | | | |
|---|---|---|---|
| 1,109,958 | 9/1914 | Bryant | 83/355 |
| 1,408,415 | 2/1922 | Smith | 83/912 X |
| 3,116,718 | 1/1964 | Krupotich et al. | 83/912 X |
| 3,132,629 | 5/1964 | Krupotich | 83/912 X |
| 3,301,116 | 1/1967 | Owen | 83/912 X |
| 3,381,564 | 5/1968 | Whiteford | 83/417 |
| 3,691,726 | 9/1972 | Stephens et al. | 83/912 X |
| 3,776,097 | 12/1973 | Rooks | 83/912 X |
| 3,797,350 | 3/1974 | Orrick et al. | 83/418 |

*Primary Examiner*—Frank T. Yost
*Attorney, Agent, or Firm*—John J. Morrissey

[57] ABSTRACT

An automated envelope opener receives a stack of unopened envelopes of varying sizes, types and shapes, and feeds these envelopes individually to a cutting station. An edge of each envelope is automatically aligned with a reference surface, whereby each such aligned envelope edge can be cut at the cutting station by a rotating multi-toothed cutter and stationary anvil which are also aligned with the reference surface. In a preferred embodiment, means are additionally provided for shingling and stacking the envelopes after they have been cut open.

10 Claims, 7 Drawing Figures

FIG. 1
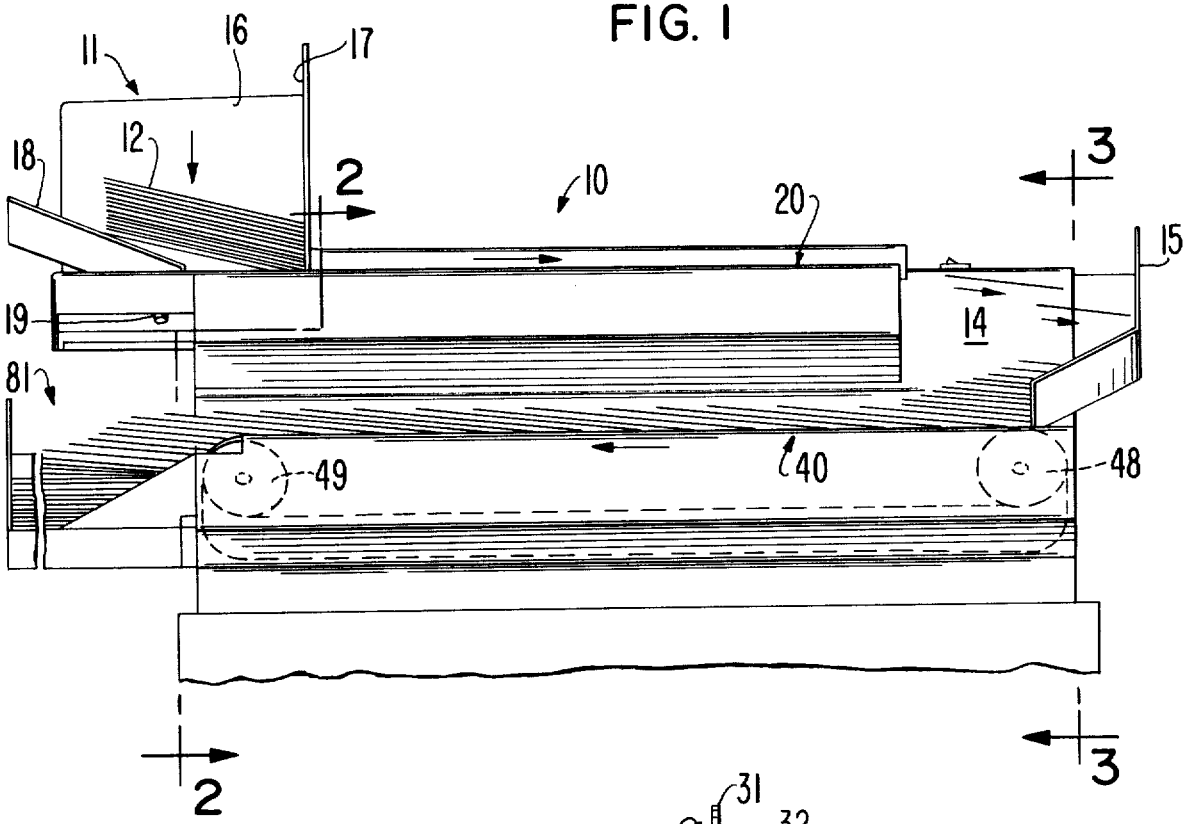
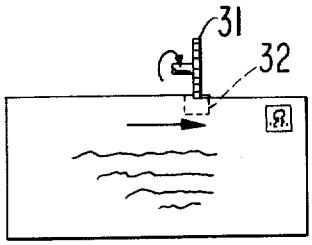
FIG. 1A
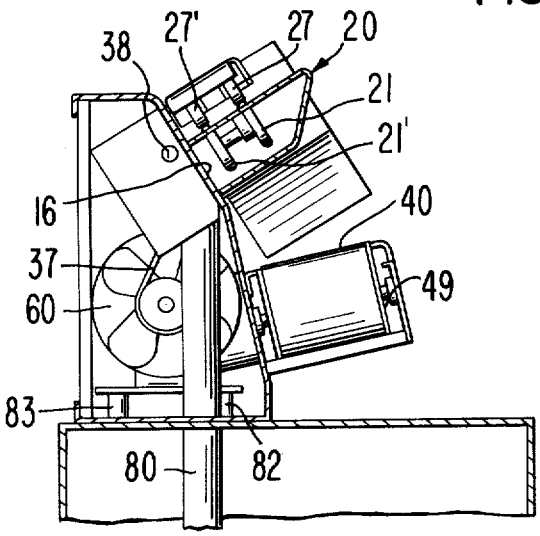
FIG. 2
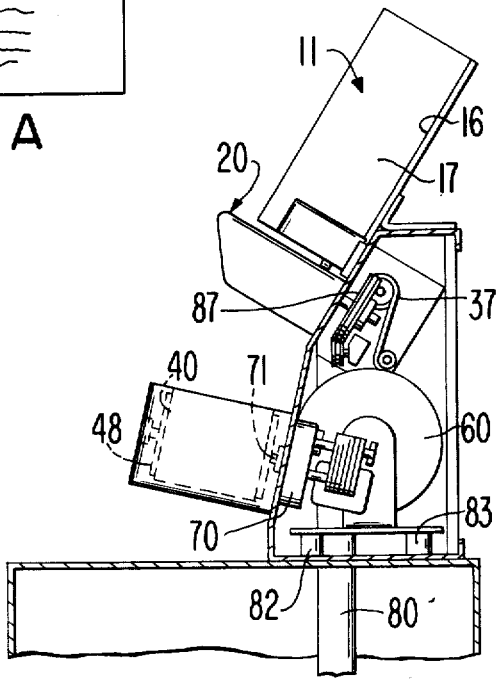
FIG. 3

FIG. 4
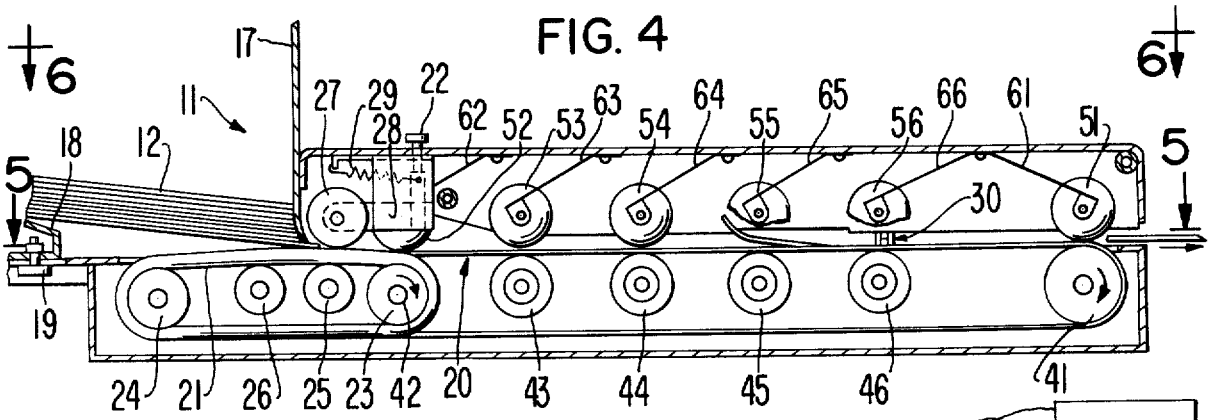
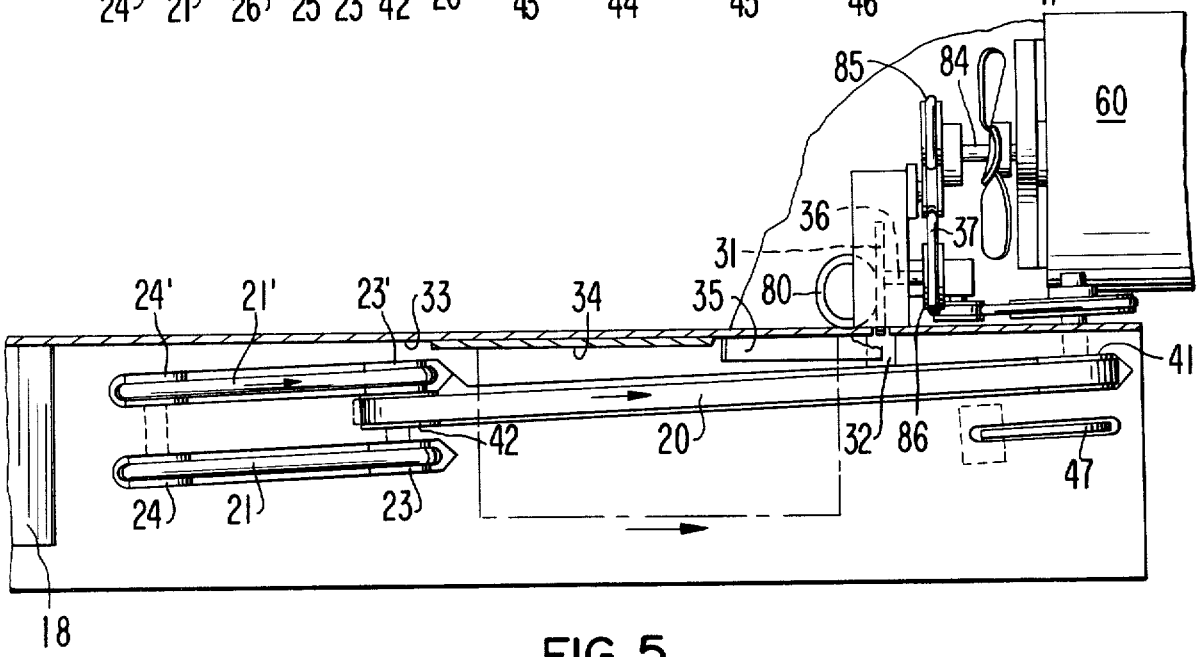
FIG. 5
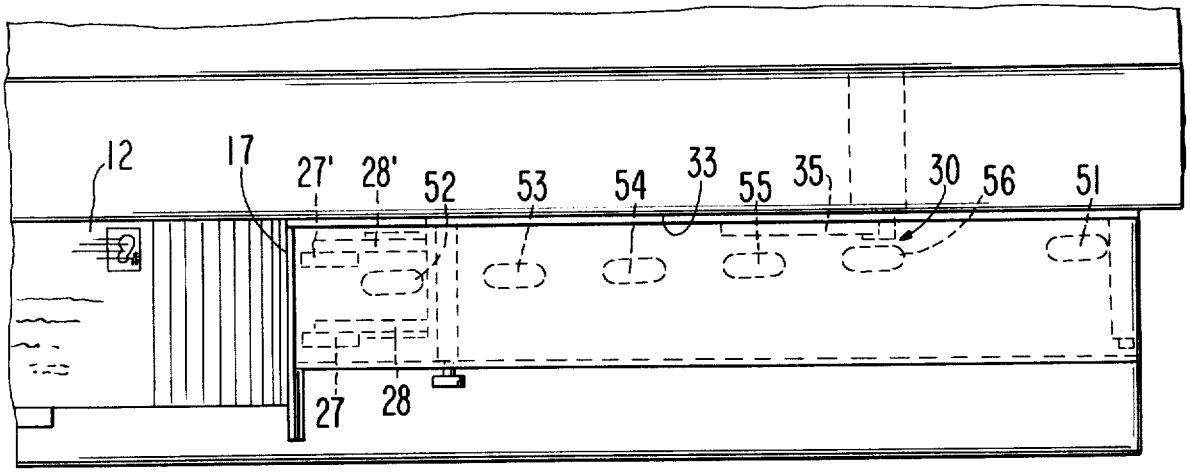
FIG. 6

AUTOMATED ENVELOPE OPENER

BACKGROUND OF THE INVENTION

1. Field of the Invention:

This invention relates generally to the automation of office procedures with respect to mail handling, and in particular comprises an automated envelope opener.

2. Description of the Prior Art:

Business and government organizations presently receive enormous volumes of mail daily. For example, the large volumes of remittance mailings received by utility companies, petroleum companies, department stores and other retail enterprises, publishers, banks and other lending institutions, insurance companies, credit card operations, medical and dental group practitioners, taxing authorities, licensing bureaus, and a host of other types of activities, demonstrate the need for an efficient incoming mail handling capability for such organizations. The projections of the U.S. Post Office indicate that the daily volumes of such mailings will increase appreciably in the future. Use of automated envelope opening apparatus would be an essential feature of any efficient office procedure for handling such large volumes of mail.

The requirements for an efficient envelope opening apparatus that would be suitable for a high-volume mail handling operation are simple to state. First, the apparatus must be capable of a high rate of envelope throughput. Second, the apparatus must be capable of mechanically cutting an entire edge of each envelope so that "finish" cutting by hand will not be necessary. Third, the apparatus must be capable of cutting the edge of each envelope without damaging, or being damaged by, any of the contents thereof. The third requirement, that the apparatus not damage or be damaged by the contents of the envelope, is especially critical where the contents of the envelope might include tabulation cards, encoded checks or folded documents, or where the contents of the envelope might include documents that are attached together by metal paper clips or staples. In addition, it would be expected that an efficient envelope opening apparatus would be easy to operate, require minimum operator attention, and provide maximum safety to office personnel.

It should be noted that envelopes generally are not of uniform size and shape. Even in the case of remittance mailings where it is usual to provide customers with standardized return envelopes, customers may frequently choose to substitute odd-sized envelopes for various reasons. Furthermore, there are many other types of activities, including product promotions, commercial announcements, and coupon-return advertisements, which generate incoming correspondence mailed in envelopes that vary considerably in size and shape. It should also be noted that, even in the case of standardized return envelopes, the manufacturing specifications for such envelopes rarely require that the opposite edges of each envelope be strictly parallel. In other words, most envelopes are not perfect rectangles — a fact that must be taken into account in the design of any automated apparatus for aligning an envelope edge with a cutting mechanism.

With presently available envelope opening machines, the problem of opening an edge of each envelope in a large stack of envelopes without damaging the contents of the envelopes has not been satisfactorily solved. Typically, with presently available envelope opening apparatus, quantities of unopened envelopes must first be placed in electrically operated jogging or vibrating machines to force the contents of each envelope away from the edge to be cut. Alternatively, the envelope opening procedure may require a manual operation wherein the operator tamps the envelopes, a handful at a time, against a table top to force the contents of each envelope away from the edge to be cut.

In addition, with many presently available envelope opening machines, it is necessary for the operator to manually hold the envelopes during the envelope cutting operation. The cuttting instrument of presently available envelope opening machines is typically a rotating-disk type of knife, which requires that a considerable portion of the envelope edge be exposed for cutting. With many presently available envelope opening machines, the operator must guide the envelopes manually toward the cutting station in order that the envelope edges to be cut will be properly aligned with respect to the cutting instrument.

With envelope opening machines known to the prior art, the envelope edge to be cut is not precisely referenced with respect to the alignment of the cutting instrument. Consequently, with such prior art machines, the cutting instrument must be set to cut an appreciable strip from the envelope edge so that a high proportion of envelopes fed to the cutting station will in fact be cut open. The cutting instrument setting is usually adjustable, but in practice it has been found necessary to use a setting of approximately 1/16 of an inch or more. Any smaller setting would result in incomplete cutting of too many of the envelopes in a batch of envelopes of typical size. Such a wide cut frequently results in damage to the contents of some envelopes, even where a jogging operation has preceded the cutting operation. Also, such a wide cut frequently causes paper clips or metal staples to become caught in the cutting blades, often damaging the cutting blades.

Furthermore, with envelope opening machines known to the prior art, the cutting operation is usually intermittent because of the necessity of first jogging or tamping each new batch of envelopes to be opened. Also, the requirement of operator attention to the feeding of envelopes toward the cutting station necessarily requires that the machine be operated at a throughput rate which is substantially less than the maximum possible operating speed of the cutting instrument.

In addition, with envelope opening machines known to the prior art, waste cuttings require special handling to be removed from the vicinity of the cutting station.

SUMMARY OF THE INVENTION

It is an object of the present invention to provide an efficient automated envelope opener that requires no operator attention during the envelope opening operation.

It is also an object of this invention to provide a high-throughput envelope opener that does not require any jogging or tamping of the envelopes prior to the cutting operating to force the contents of the envelopes away from the edges to be cut.

It is likewise an object of this invention to provide an automated envelope opener in which waste cuttings are removed from the vicinity of the envelope cutting instrument without special handling of the waste cuttings.

It is a further object of this invention to provide a high-throughput envelope opener that completely cuts from end to end an edge of each envelope in a batch of envelopes.

It is also a further object of this invention to provide an envelope opener in which one sheet of an envelope is cut slightly closer to the envelope edge than is the other sheet of the envelope, whereby the separation of the two sheets of the opened envelope is facilitated so as to make easier the subsequent extraction of the contents of the envelope.

It is also a further object of this invention to provide an envelope opener in which the paper edges of each sheet of the opened envelope are blunt or "feathered" rather than sharp, whereby personnel who extract the contents of the envelope can more easily avoid cutting their fingers on the paper edges.

Another object of this invention is to provide an envelope opening machine that can open a random mix of envelopes of various sizes, types and shapes.

A related object of this invention is to provide an envelope opening machine that can open a random mix of envelopes of various sizes, types and shapes in a precisely uniform manner.

Yet another object of this invention is to provide an automated envelope opening machine that is unaffected in its operation by the presence of metallic objects such as paper clips or staples in the envelopes to be opened.

A particular object of this invention is to provide a high-speed envelope opening machine which combines automatic feeding of a large batch of envelopes to a cutting instrument, automatic cutting of an edge from each envelope in the batch, automatic stacking of the opened envelopes in a shingled arrangement, and automatic removal of waste cuttings from the vicinity of the cutting instrument with convenient collection of the waste cuttings.

A more particular object of this invention is to provide a high-speed, high-throughput envelope opening machine in which envelopes can be placed on a feeder means to a cutting instrument or can be removed from a stacking device after having been cut open while the cutting instrument is in operation and without interruption of the cutting operation.

An object of this invention, in detail, is to provide an automated envelope opening machine having a means for aligning an edge of each envelope of a batch of envelopes of various sizes, types and shapes with a particular reference surface, and a means for cutting the aligned edge of each envelope by a rotating toothed cutter and stationary anvil that are disposed to cut substantially along that reference surface.

BRIEF DESCRIPTION OF THE DRAWING

FIG. 1 is a cross-sectional view of an envelope opener according to the present invention.

FIG. 1A shows an envelope with an edge thereof being cut by the rotating toothed cutter and stationary anvil according to this invention.

FIG. 2 shows a view of the envelope opener of FIG. 1 taken along line 2—2.

FIG. 3 shows a view of the envelope opener of FIG. 1 taken along line 3—3.

FIG. 4 shows in greater detail the conveyor means of the envelope opener of FIG. 1 for transporting envelopes to the cutting instrument.

FIG. 5 shows a view of the conveyor means of FIG. 4 taken along line 5—5.

FIG. 6 shows a view of the conveyor means of FIG. 4 taken along line 6—6.

DESCRIPTION OF A PREFERRED EMBODIMENT

An automated envelope opening machine 10 according to the present invention is illustrated in the accompanying drawing. An input hopper 11, which is shown at the upper left in FIG. 1, receives a stack 12 of unopened envelopes of various sizes, types and shapes. As indicated by the directional arrows in FIGS. 1 and 4, unopened envelopes pass individually from the bottom of the stack 12 onto a transport conveyor 20 which transports them from left to right past a cutting station 30 as seen in FIGS. 4 and 6. At the cutting station 30, a rotating cutting instrument 31 (which is preferably a multi-toothed cutter similar to a milling cutter) in combination with a stationary anvil 32, opens each of the envelopes in turn as they pass from left to right on the conveyor 20. The opening of each envelope is accomplished by cutting away an edge thereof, as illustrated in FIG. 1A. After having been opened, each envelope continues to be transported by the conveyor 20 to the right for a relatively short distance until the envelope reaches the right-hand end of the conveyor 20, at which time the opened envelope is projected further to the right into a receiving volume 14 because of the inertia acquired by the envelope while on the conveyor 20. A limiting plate 15 arrests the forward motion of the projected envelopes, and causes each opened envelope in turn to drop onto another conveyor 40 which is disposed underneath the conveyor 20. The conveyor 40 causes the opened envelopes to be transported from right to left, counter to the directon of motion of the unopened envelopes. The conveyor 40 does not run continuously, but rather runs only when envelopes are passing along the conveyor 20 so as to produce a shingled arrangement of the opened envelopes thereon as illustrated in FIG. 1. It is noted that the conveyor 40 with its associated means (to be described hereinafter) for producing the shingled arrangement of the opened envelopes is an optional feature of the preferred embodiment of the present invention, and that for particular purposes it might be desirable to make an automated envelope opening machine which merely uses the envelope opening feature described herein without utilizing the shingling feature. In such a case, an output hopper could be installed in the receiving volume 14 to collect the opened envelopes as they are projected from the conveyor 20.

The hopper 11 comprises a rear wall 16 which is tilted by an appropriate angle from the vertical, for example, by 30 degrees, as can be seen in FIG. 3. The unopened envelopes are stacked in the hopper 11 with the envelope edges that are to be cut open being in contact with the rear wall 16. In the usual case, a long edge of each envelope will be placed in contact with the rear wall 16. The tilt of the rear wall 16 from the vertical serves to bias the envelopes against the rear wall 6 and thus eliminates the need for any front envelope confining wall parallel to the rear wall 16. The hopper 11 also comprises an envelope confinement plate 17 which is perpendicular to the rear wall 16, and which serves as a forward reference surface for feeding the envelopes to the cutting station 30 and for preventing the envelopes from falling to the right onto the conveyor 20. The hopper 11 also comprises an additional envelope confinement plate 18 which is a plane inclined at a suitable angle from the horizontal, for example, ten to twenty degrees, as can be seen in FIGS. 1 and 4. The plate 18 provides a restraint to prevent the stacked envelopes from falling to the left, and also assists in feeding the envelopes individually from the bottom of the stack 12 onto the conveyor 20 by providing an elevation of the trailing end of each envelope as it passes onto the conveyor 20. The inclined plate 18 is adjustably movable to the right or to the left by a thumb screw 19 disposed within a slot, the length of the slot being determinative of the extent to which the plate 18 can be moved. The plate 18 is positioned according to the length of the envelopes so as to raise the trailing edge of the bottommost envelope to a suitable height for convenient single feeding of the envelopes onto the conveyor 20.

The means for feeding the bottommost envelope of the stack 12 onto the conveyor 20 comprises a pair of parallel rubber feeder belts 21 and 21' disposed under the stack 12 and in contact with the bottommost envelope of the stack 12. The feeder belts 21 and 21' are endless belts which pass, respectively, over the pulleys 23 and 24 for the belt 21 and over the pulleys 23' and 24' for the belt 21', so that each feeder belt has an upper portion which moves from left to right and a lower portion which moves from right to left. In an operating embodiment of this invention, it has been found helpful to provide a pair of rollers 25 and 26, which are affixed to the framework of the machine 10, for vertical support of the feeder belts 21 and 22. The upper portions of the feeder belts 21 and 21' are in contact with the bottommost envelope in the stack 12. When the machine 10 is operating, the movement of the feeder belts 21 and 21' tends to move the bottommost envelope from left to right because of friction between the rubber belts and the envelope surface. Because of the weight of the upper envelopes on the bottommost envelope, motion of the bottommost envelope from left to right tends to cause envelopes on top of it to move from left to right also. Therefore, a separator assembly is used to provide single one-at-a-time feeding of the envelopes from stack 12 by means of the feeder belts 21 and 21' onto the conveyor 20.

The separator assembly comprises a pair of wheel-like stones 27 and 27' of carborundum or other similar material which are mounted on levers 28 and 28', respectively, that pivot about bearing points in such a way that tension springs 29 and 29' (not shown), respectivey, urge the stones 27 and 27' down into contact with the upper surface of any envelope moving from the bottom of the hopper 11 toward the conveyor 20. The separator stones 27 and 27' are mounted immediately to the right of the confinement plate 17 as seen in FIG. 4. The vertical clearance between the separator stones 27 and 27' and the feeder belts 21 and 21' is adjustable by means of adjustment screws 22 and 22' (not shown) depending upon the average thickness of the envelopes to be opened. As the feed belts 21 and 21' move the bottommost envelope to the right, the envelopes in the stack 12 above the bottommost envelope also tend to move to the right. However, those envelopes above the bottommost envelope which might tend to pass under the confinement plate 17 thereupon come into contact with the separator stones 27 and 27'. In particular, the upper surface of the envelope immediately above the bottommost envelope in the stack 21 comes into contact with the separator stones 27 and 27'. Since the coefficient of friction between paper and rubber is greater than the coefficient of friction between paper and the abrasive material (e.g., carborundum) of which the separator stones are made, the bottommost envelope can be moved freely by the feeder belts 21 and 21' from left to right onto the conveyor 20 while the envelope immediately above the bottommost envelope is restrained by the separator stones 27 and 27'. Since the coefficient of friction between the separator stones and paper is greater than the coefficient of friction between paper and paper, the bottommost envelope moves freely to the right while the next envelope immediately on top of the bottom envelope is restrained. Consequently, when the bottommost envelope has passed onto the conveyor 20, the envelope which was immediately on top of it becomes in turn the bottommost envelope and can in its own turn pass singly onto the conveyor 20.

After an envelope passes from the feeder belts 21 and 21' onto the conveyor 20, it is moved to the right and urged into contact with a guiding reference surface 33 by the conveyor 20. The reference surface 33 is coplanar with the rear wall 16 of the hopper 11; and the envelope edge which is to be cut open is urged into contact with this reference surface 33. As can be seen in FIG. 5, the feeder belts 21 and 21' and the conveyor 20 are oriented at a suitable angle with respect to the reference surface 33, for example, two to three degrees, in order to bias the motion of the envelopes into firm contact with the reference surface 33.

The conveyor 20 comprises an endless belt, which may be made of treated woven cloth, and which is tensioned between a drive roller 41 and a driven roller 42. The pulleys 23 and 23' are integral with the driven roller 42, so that the driven roller 42 serves to drive the feeder belts 21 and 21'. Disposed at intervals beneath the conveyor 20 are a suitable number of idler rollers, as shown in FIG. 4 by the reference numbers 43, 44, 45 and 46, to provide vertical support for the conveyor 20 so that the envelopes will be maintained on a substantially unvarying horizontal plane in their passage from left to right toward the cutting station 30. In order to hold the envelopes firmly on the conveyor 20, a series of hold-down idler rollers are provided which bear gently but firmly down upon the envelopes as they pass in turn toward the cutting station 30. As shown in FIG. 4, the hold-down idler rollers 52, 53, 54, 55, 56 and 51 are each mounted to a frame member of the machine 10 by a corresponding leaf spring 62, 63, 64, 65, 66 and 61, respectively. The hold-down roller 51 is mounted vertically above the drive roller 41, the hold-down roller 52 is mounted vertically above the driven roller 42, and the hold-down rollers 53, 54, 55 and 56 are mounted vertically above the conveyor supportive idler rollers 43, 44, 45 and 46, respectively. The conveyor supportive rollers and the hold-down rollers are aligned with the conveyor 20 so as to urge the envelopes into contact with the reference surface 33.

In order to prevent an envelope from "climbing" the reference surface 33, a hold-down restraining plate 34 is mounted against the reference surface 33. The hold-down plate 34, which may suitably be approximately ¼ inch thick, is mounted approximately ¼ inch above the plane of the conveyor 20. Thus, as an envelope passes along the conveyor 20 toward the cutting station 30, it is confined to a vertical space of not more than ¼ of an inch and cannot climb higher up the reference surface 33. The hold-down plate 34 may be adjustably mounted to provide a choice of vertical clearances depending upon the maximum thickness of the envelopes to be opened. The hold-down plate 34 may also be mounted at a slight angle with respect to the horizontal plane of the conveyor 20 to provide a higher clearance at the left-hand end of the plate 34 and a lower clearance at the right-hand end. In this case, the hold-down plate 34 will receive puffy envelopes and serve to flatten them as they pass toward the cutting station 30.

The cutting station 30 comprises a rotating multi-toothed cutting instrument 31, having a plurality of blades disposed on a circular support structure that rotates in a plane perpendicular to the plane of the reference surface 33. In particular, the cutting instrument 31 preferably comprises a circular toothed cutter similar to a milling cutter. Each tooth of the cutter 31 comprises a blade whose cutting edge remains always parallel to the reference surface 33 as the circular cutter 31 undergoes a complete rotation. The plane of the reference surface 33 lies tangent to the circular cutter 31, and the edge of each blade will "cut" the plane of the reference surface 33 during each rotation of the cutter 31. The cutter 31 is mounted on a shaft 36 which is rotationally driven by a belt 37, which is driven by a motor 60 as will be described more fully hereinafter. The cutter 31 is rotated at a high speed, which typically may be 2400 revolutions per minute. Disposed axially from the cutter 31 is a stationary sharpened anvil 32, which may be constructed of a standard screw-mounted carbide cutting tip of the type frequently used in machining operations. The anvil 32 is rigidly mounted on an adjustable bar (not shown) which is pivotally attached to the cutting station assembly slightly below the centerline of the rotating cutter 31. The anvil 32 is adjusted to provide substantially zero clearance between the anvil 32 and the rotating blades of the cutter 31. Thus, as each blade passes by the anvil 32 during the rotation of the cutter 31, each of the blade will remove a small portion of the edge of the envelope which abuts the reference surface 33. The total number of cuts removed from the envelope edge is a function of the speed of the envelope in passing along the conveyor 20 past the cutting station 30, the rate of rotation of the cutter 31, and the number of teeth (i.e., cutting blades) in the cutter 31. The anvil 32 is mounted parallel to the horizontal plane of the conveyor 20; and the cutter 31 is mounted so that its cutting blades protrude out from the reference surface 33 by a small amount determined by the depth of the cut desired for the envelope edge. Normally, a cut of only a few thousandths of an inch is all that is desired. Thus, as an envelope moves from left to right, its edge to be cut open is urged into contact with the reference surface 33 and is forced past the cutting station 30 where a small portion of the envelope is cut away. Only the minimum amount of envelope material that must be removed to open the envelope is actually cut away. In practice, it has been found that an envelope can be fully opened along an edge from end to end without damage to the contents of the envelope, even where the contents of the envelope lie immediately adjacent the edge which is cut open. In order to control the precision of the cutting more fully, a flat spring 35 may be attached to the hold-down plate 34 so as to bear down against the envelope edge which is to be cut and to urge it firmly against the anvil 32. The flat spring 35 serves to force bent envelope corners to lie in the plane of the conveyor 20, thereby providing a straight envelope edge for presentation to the cutting blades.

It is a feature of the milling-cutter type of cutting instrument of this invention that the cut edges of envelopes that have been cut by the cutter 31 wll be blunt or "feathered" to the touch, as contrasted with the oftentimes sharp edges that result from cuts made with a circular blade that rotates parallel to the orientation envelope edge which is to be cut. This feature is a decided advantage to personnel who will subsequently remove the contents of the opened envelopes. Sharp opened envelope edges can cause hangnails and inflict nasty cuts on the fingers. The occurrence of such injuries is minimized with an envelope opener according to the present invention.

It is another feature of the milling-cutter type of cutting instrument of this invention that the rotating motion of the cutter 31 serves to draw air in through the draft hole 38 in the housing of the cutter 31 and in through the gap exposing the cutter. In effect, the rotating cutter 31 also serves as an induction fan or blower to draw the small envelope cuttings away from the cutter 31 down into a tube 80 located beneath the cutter 31. The tube 80 leads conveniently to a waste basket placed underneath the machine 10.

After an envelope has been cut open, it will continue moving to the right on the conveyor 20. In moving to the right, the opened envelope will depress a switch lever 47 that operates the shingling conveyor 40 which is disposed underneath the conveyor 20. It is significant that the upper portion of the shingling conveyor 40 is thereby caused to move from right to left only when envelopes are actually being opened. In this way, shingling of the opened envelopes along the conveyor 40 can be accomplished. The location of the shingling conveyor 40 below the conveyor 20 provides for high capacity envelope stacking with a minimum of floor space needed by the machine.

The shingling conveyor 40 comprises an endless belt, which may be made of treated woven cloth, and which is tensioned between rollers 48 and 49 as shown in FIG. 1. The shingling conveyor assembly is most conveniently attached to the main structural frame of the envelope opening machine 10. Roller 48 is a drive roller which is attached to the shaft 71 of an electric motor 70, and the motor 70 is activated when the switch lever 47 is depressed as discussed above. The shingling conveyor 40 causes the opened envelopes to move from right to left. An output hopper 81 may conveniently be located at the left-hand end of the shingling conveyor 40 to receive the opened envelopes.

Power to drive the transport conveyor 20 is provided by the electric motor 60, which is mounted on shock mounts 82 and 83 in order to reduce vibration and noise. Affixed to the shaft 84 of the motor 60 is a drive pulley 85 around which the belt 37 is fitted. Power that is transmitted by the belt 37 to a pulley 86 on the shaft 36 upon which the cutter 31 is mounted causes the cutter 31 to rotate. The cutter shaft 36 is substantially parallel to the shaft 84 of the motor 60, whereas the axis of the drive roller 41 of the conveyor 20 is approximately perpendicular to the shaft 84. Therefore, in order to drive the conveyor 20 from the motor 60, it is necessary to change the direction of the belt 37 after it passes the pulley 86 on the cutter drive shaft 36. This change of direction is accomplished by a fairlead assembly which comprises two pulleys 87 and 87' (not shown) which guide the belt 37 around to the proper orientation for engaging the drive roller 41. The drive roller 41 drives the conveyor 20 and also drives the roller 42, which in turn drives the feeder belts 21 and 21'.

Although this invention has been described herein with respect to a particular preferred embodiment, it will be recognizeed by those skilled in the art that various specific changes in the form and arrangement of parts may be made without departing from the spirit and scope of the invention. Consequently, the description herein is not to be construed in a limiting sense but rather is to be understood as being illustrative of a particular embodiment of the invention which is limited only by the following claims.

What is claimed is:

1. An envelope opening machine comprising conveyor means for transporting an envelope along a linear path to a cutting station, bias means for constraining an edge of said envelope to assume an orientation parallel to a reference plane at said cutting station, cutting means disposed adjacent said path, said cutting means comprising a plurality of blades which are parallel to said reference plane at said cutting station, said blades being rotatable in a plane perpendicular to said reference plane and being disposed inside a housing to contact said envelope edge at said cutting station, said housing being apertured so that the rotation of said blades causes air to be drawn into said housing thereby causing an air draft for automatically blowing envelope edge cuttings away from said cutting station, and means for rotating said blades.

2. The apparatus of claim 1 further comprising means for receiving a plurality of envelopes to be opened, and means for feeding said envelopes one at a time from said receiving means to said conveyor means.

3. The apparatus of claim 2 wherein said envelope receiving means comprises means for forming a stack of said envelopes one on top of another, and wherein said feeding means comprises means for feeding said envelopes one at a time from the bottom of said stack to said conveyor means.

4. The apparatus of claim 3 wherein said means for feeding said envelopes from the bottom of said stack comprises belt means disposed to make frictional contact with the bottommost envelope of said stack and to move said bottommost envelope toward said conveyor means, and separator means disposed to make frictional contact with the next envelope immediately above said bottommost envelope in said stack so as to restrain passage of said next envelope toward said conveyor means until said bottommost envelope has passed toward said conveyor means.

5. The apparatus of claim 1 comprising planar surface means disposed parallel to said path, said planar surface means determining said reference plane, and wherein said bias means comprises means for providing a nonparallel orientation of said conveyor means relative to said path so that the edge of said envelope that is to be cut is urged into contact with said planar surface means.

6. The apparatus of claim 1 further comprising means disposed adjacent said path for flattening said envelope as said envelope passes to said cutting station.

7. The apparatus of claim 1 further comprising anvil means disposed adjacent said path at said cutting station so that said envelope edge to be cut passes between at least one of said blades and said anvil at said cutting station.

8. The apparatus of claim 1 further comprising means disposed adjacent said cutting station for leading said envelope edge cuttings to waste disposal means.

9. An envelope opening machine comprising means for receiving a plurality of envelopes to be opened, means for feeding said envelopes one at a time from said receiving means to a conveyor means for transporting each envelope along a linear path to a cutting station, bias means for constraining an edge of said envelope to assume an orientation parallel to a reference plane at said cutting station, cutting means disposed adjacent said path, said cutting means comprising a blade which is parallel to said reference plane at said cutting station, said blade being disposed to contact said envelope edge at said cutting station, shingling conveyor means disposed below said transport conveyor means to said cutting station, said shingling conveyor means being arranged to receive envelopes that have been opened at said cutting station, and switch means responsive to the exit of each opened envelope from said cutting station for causing said shingling conveyor means to move only when envelopes are being opened.

10. The apparatus of claim 9 wherein said shingling conveyor means moves the opened envelopes in a shingled arrangement in a direction opposite to the direction of motion of the unopened envelopes toward said cutting station.

* * * * *